US010294432B2

(12) United States Patent
Srivastava et al.

(10) Patent No.: US 10,294,432 B2
(45) Date of Patent: May 21, 2019

(54) STEAM CRACKER PRODUCT FRACTIONATION

(71) Applicant: ExxonMobil Chemical Patents Inc., Baytown, TX (US)

(72) Inventors: Alok Srivastava, Houston, TX (US); David C. Dutschmann, Humble, TX (US); Thomas W. Pavia, Houston, TX (US)

(73) Assignee: ExxonMobil Chemical Patents Inc., Baytown, TX (US)

( * ) Notice: Subject to any disclaimer, the term of this patent is extended or adjusted under 35 U.S.C. 154(b) by 234 days.

(21) Appl. No.: 15/098,559

(22) Filed: Apr. 14, 2016

(65) Prior Publication Data

US 2016/0376511 A1 Dec. 29, 2016

Related U.S. Application Data

(60) Provisional application No. 62/185,276, filed on Jun. 26, 2015.

(30) Foreign Application Priority Data

Sep. 10, 2015 (EP) ..... 15184578

(51) Int. Cl.

| | |
|---|---|
| ***C10G 69/06*** | (2006.01) |
| ***C10G 45/32*** | (2006.01) |
| ***C10G 75/00*** | (2006.01) |
| ***C10G 9/36*** | (2006.01) |

(52) U.S. Cl.

CPC ..... *C10G 69/06* (2013.01); *C10G 9/36* (2013.01); *C10G 45/32* (2013.01); *C10G 75/00* (2013.01); *C10G 2300/4075* (2013.01)

(58) Field of Classification Search

CPC combination set(s) only.
See application file for complete search history.

(56) References Cited

U.S. PATENT DOCUMENTS

| | | | | |
|---|---|---|---|---|
| 6,210,561 | B1 * | 4/2001 | Bradow | C10G 45/08 208/130 |
| 6,632,351 | B1 | 10/2003 | Ngan et al. | |
| 7,090,765 | B2 | 8/2006 | Spicer et al. | |
| 7,097,758 | B2 | 8/2006 | Stell et al. | |
| 7,138,047 | B2 | 11/2006 | Stell et al. | |
| 7,220,887 | B2 | 5/2007 | Stell et al. | |
| 7,235,705 | B2 | 6/2007 | Stell | |
| 7,244,871 | B2 | 7/2007 | Stell et al. | |
| 7,247,765 | B2 | 7/2007 | Stell et al. | |
| 7,297,833 | B2 | 11/2007 | Beattie et al. | |

(Continued)

OTHER PUBLICATIONS

M. Sprague et al. "Performance Evaluation and Fouling Mitigation in a Gasoline Fractionator", Proceedings of AIChE Spring National Meeting, Orlando Florida (2006).

(Continued)

*Primary Examiner* — Michelle Stein

(57) ABSTRACT

The invention generally relates to processes for separating steam cracker products by fractional distillation, and to systems and apparatus useful in such processes. More specifically, the invention relates to decreasing the amount of fractionator fouling that can result from increasing the amount of hydrocarbon molecules in the steam cracker feed having four or fewer carbon atoms.

20 Claims, 4 Drawing Sheets

(56) References Cited

U.S. PATENT DOCUMENTS

| | | | | |
|---|---|---|---|---|
| 7,311,746 | B2 | 12/2007 | Stell et al. | |
| 7,312,371 | B2 | 12/2007 | Stell et al. | |
| 7,351,872 | B2 | 4/2008 | Stell et al. | |
| 7,488,459 | B2 | 2/2009 | Stell et al. | |
| 7,578,929 | B2 | 8/2009 | Stell et al. | |
| 7,820,035 | B2 | 10/2010 | McCoy et al. | |
| 8,083,931 | B2 | 12/2011 | McCoy et al. | |
| 2005/0261537 | A1* | 11/2005 | Stell | C10G 9/00 585/648 |
| 2008/0128323 | A1* | 6/2008 | McCoy | C10G 9/002 208/44 |
| 2009/0194458 | A1* | 8/2009 | Ou | C10G 9/00 208/95 |
| 2014/0357923 | A1 | 12/2014 | Pavia et al. | |

OTHER PUBLICATIONS

M. Jain et al., "Reduce Fouling & Corrosion Risks and Improved Reliabity While Transiting to Mixed Feed Operations,", Proceedings of AIChE Spring National Meeting, San Antonio, Florida 2013.

* cited by examiner

STEAM CRACKER PRODUCT FRACTIONATION

PRIORITY

This invention claims priority to and the benefit of U.S. Ser. No. 62/185,276, filed Jun. 26, 2015, and EP application 15184578.1 filed Sep. 10, 2015, both of which are herein incorporated by reference.

FIELD

The invention generally relates to processes for separating steam cracker products by fractional distillation, and to systems and apparatus useful in such processes. More specifically, the invention relates to decreasing the amount of fractionator fouling that can result from increased amounts of $C_{4-}$ hydrocarbon molecules in the steam cracker feed.

BACKGROUND

Light olefin (e.g., $C_{4-}$ olefin) can be used to make a wide range of useful products. For example, ethylene and/or propylene can be polymerized to produce polymer, such as polyethylene, polypropylene, ethylene-propylene copolymer, etc. Hydrocarbon pyrolysis (e.g., steam cracking) is one common way to produce light olefin.

Besides light olefin, steam cracker effluent typically contains molecules boiling in the naphtha boiling-range (hereinafter "steam cracker naphtha" or "SCN"). Steam cracker naphtha comprises a mixture of compounds (including olefins) having an initial atmospheric boiling point in the range of about 25° F. (−3.9° C.) to about 35° F. (1.7° C.) and a final atmospheric boiling point in the range of about 430° F. (221° C.) to about 550° F. (288° C.). Steam cracker effluent also generally contains compounds having atmospheric boiling points in the gas oil boiling range (hereinafter "steam cracker gas oil", or "SCGO"). Like SCN, SCGO comprises a mixture of compounds, primarily a mixture of hydrocarbon compounds. Although there is typically an overlap between SCN and SCGO in composition and boiling point range, SCGO typically has an initial atmospheric boiling point that is approximately the same as or greater than the SCN's final atmospheric boiling point. The SCGO's final atmospheric boiling point is typically about 1050° F. (566° C.). Steam cracker effluent can also contain steam cracker tar having an atmospheric boiling point >about 1050° F. (566° C.).

It is conventional to cool steam cracker effluent by directly or indirectly contacting the effluent with a quench medium such as quench oil. Effluent cooling leads to condensation into the liquid phase of at least a portion of the SCGO. The SCN and light olefin typically remain in the vapor phase after effluent cooling, so that the primarily liquid-phase phase SCGO can be separated and conducted away. This separation is typically carried out in a primary fractionator.

Generally, at least three streams are conducted away from the primary fractionator: (i) a vapor stream comprising molecular hydrogen, light hydrocarbon (including light olefin), and SCN; (ii) a liquid stream comprising SCGO; and (iii) a tar stream comprising steam cracker tar. Typically, the primary fractionator includes a rectification region and a stripping region. The rectification region concentrates into the vapor phase those components of the steam cracker effluent having greater volatility, e.g., SCN and light olefin. The stripping region concentrates into the liquid phase those components of the steam cracker effluent having lesser volatility, e.g., SCGO. Some primary fractionators include a collection/distribution region located between the stripping and rectification regions for collecting and distributing into the stripping region liquid that is disengaged from vapor in the rectification region.

The separated vapor conducted away from the primary fractionator's rectification region typically comprises molecular hydrogen, $C_{4-}$ hydrocarbon (including light olefin), and SCN. Additional quenching stages can be used for condensing at least a portion of the SCN in the separated vapor. The condensed SCN and quench water are typically recovered from the $C_{4-}$ hydrocarbon vapor in a separation stage, which can include, e.g., one or more flash drums. The additional quenching stage can be carried out in a quenching vessel, an exchanger, or in a third region (a quenching region) of the primary fractionator, the quenching region being located above the primary fractionator's rectification region. The molecular hydrogen and $C_{4-}$ hydrocarbon (including the light olefin) are conducted from the flash drum as a vapor-phase (e.g., as flash-drum vapor) to one or more recovery stages for recovering one or more the desired light olefin (e.g., ethylene and/or propylene). These can be stored and/or subjected to further processing, such as polymerization. Separated SCN and quench water are conducted away from the flash drum, typically as flash drum bottoms. Quench water is typically separated from the SCN by gravity separation, e.g., in a settling vessel.

The separated SCN (primarily in the liquid phase) is typically divided into two streams of substantially the same composition. The first SCN stream is recycled to the fractionator (e.g., as reflux). The second SCN stream is typically subjected to further processing to produce motor gasoline and motor gasoline blending components. An aqueous stream is also typically recovered, for example, when the quenching includes directly contacting the steam cracker effluent with water.

One common primary fractionator generally has the form of a substantially-cylindrical vessel with a greater diameter in the stripping region (the vessel's lower region) and a lesser diameter in the rectification region (the vessel's upper region). The cylindrical vessel's long axis is typically perpendicular to the surface of the earth. When oriented this way, liquid SCN reflux results in additional downflow of liquid in the rectification region of the fractionator vessel, leading to additional cooling of upflowing vapor-phase components. This in turn leads to increased condensation into the liquid phase, which increases fractionator efficiency. The increased fractionator efficiency provides greater purity in separated vapor and liquid phases conducted away from the fractionator.

It has been reported that liquid SCN reflux comprises foulant precursors such as styrene, indene, dicyclopentadiene, divinylbenzene, decalin, tetralin, naphthalene, and alkylated derivatives thereof. See, e.g., Performance Evaluation and Fouling Mitigation in a Gasoline Fractionator, M. Sprague, et al., Proceedings of AIChE Spring National Meeting, Orlando Fla., (2006). The reference discloses that fractionator fouling results primarily from maldistribution of liquid SCN reflux in the rectification region. The liquid maldistribution leads to short-circuiting of the reflux to higher-temperature regions of the tower. This results in less efficient disengagement of the vapor in the fractionator and also increased foulant polymerization and accumulation. Foulant accumulation was controlled by lessening the amount of reflux short-circuiting and by utilizing certain stainless steels in fractionator locations that are particularly prone to fouling. Should the foulant precursors accumulate to an amount that cannot be mitigated by these methods, the SCN reflux's foulant content can be lessened by periodically purging the reflux loop, e.g., by periodically increasing the relative volumetric flow of the second SCN stream and decreasing the relative volumetric flow of the first SCN (reflux) stream.

More recently, it has become desirable to produce light olefin by steam cracking relatively low molecular weight feeds such as ethane. As reported in Reduce Fouling & Corrosion Risks and Improved Reliability While Transiting to Mixed Feed Operations, M. Jain et al., Proceedings of AIChE Spring National Meeting, San Antonio, Fla., (2013), steam cracking light gases produces more light olefin but less SCN and SCGO than does the steam cracking of liquid hydrocarbon feeds. Consequently, increasing the amount of light gases in the steam cracker feed results in an increase in vapor volumetric flow rate relative to liquid in the fractionator, and an increase in the amount of foulant precursors in the first (reflux) SCN stream and the second SCN stream. The increased amount of foulant precursors in the SCN causes additional fractionator fouling and an undesirable increase in naphtha mass density. In pyrolysis systems where the quenching of the steam cracker effluent includes a direct quench of the SCN with quench water, the increased naphtha density and the increased amount of foulant precursor in the SCN also increases emulsification of the naphtha-quench water mixture, which decreases naphtha separation efficiency, leading to a further increase in fractionator fouling.

The Jain reference discloses that these difficulties can be at least partially overcome using chemical antifouling agents and by introducing gasoline from an external source into the primary fractionator (e.g., via the SCN reflux stream). Another conventional way to overcome this difficulty is to periodically increase the relative amount of liquid hydrocarbon in the steam cracker feed under substantially constant steam cracking conditions, while decreasing or maintaining substantially constant the volumetric flow rate of the second naphtha stream. The increased amount of liquid hydrocarbon in the steam cracker feed is then maintained, at least until the desired volumetric flow rate is achieved in the SCN reflux loop. These conventional methods are undesirable for several reasons. First, the use of antifouling agents and gasoline from an external source is inefficient and costly. Moreover, modifying the steam cracker feed system to allow for the periodic introduction of liquid hydrocarbon feed increases the complexity of feed system piping and leads to unfavorable process economics particularly when the marginal cost of liquid hydrocarbon feeds significantly exceeds that of gaseous feeds.

It is therefore desired to increase the amount of gaseous hydrocarbon in the steam cracker feed while lessening or eliminating the need for (i) antifouling agents, (ii) an external naphtha source, (iii) periodic purging of the SCN reflux loop, and (iv) periodically increasing the amount of liquid hydrocarbon in the steam cracker feed.

SUMMARY OF THE INVENTION

The invention is based in part on the development of a steam cracking process which includes subjecting a portion of an SCN product stream, typically the second portion, to relatively mild hydroprocessing and then returning at least a portion of the hydroprocessed SCN to the fractionator as reflux.

Accordingly, certain aspects of the invention relate to a process for steam cracking hydrocarbon. The process comprises combining a hydrocarbon feed with steam to produce a steam cracker feed, and exposing the steam cracker feed to a temperature>400° C. under steam cracking conditions to produce a steam cracker effluent that is at least partially in the vapor phase. The steam cracker effluent is cooled to condense at least a portion of the vapor phase into a liquid phase, and at least a portion of the steam cracker effluent's vapor phase is separated from the liquid phase in at least one fractionator. The separated vapor phase, which comprises molecular hydrogen, methane, and $C_{2+}$ hydrocarbon, is cooled to condense a steam cracker naphtha comprising diolefin and $C_{5+}$ hydrocarbon. This stream is divided into first and second steam cracker naphtha streams. The first steam cracker naphtha is introduced into the fractionator as a first reflux stream. At least a portion of the second steam cracker naphtha stream is hydroprocessed under hydroprocessing conditions effective for dimerization of at least a portion of the second steam cracker naphtha stream's hydrocarbon and hydrogenation of at least a portion of the second steam cracker naphtha stream's diolefin to produce a hydroprocessed steam cracker naphtha. At least a portion of the hydroprocessed steam cracker naphtha is transferred to the fractionator as a second reflux stream.

In other aspects the invention relates to a method for lessening steam cracker fractionator fouling. The method operates during at least two time intervals, which can be overlapping or non-overlapping intervals, typically non-overlapping. During the first time interval, a hydrocarbon feed is combined with steam to produce a steam cracker feed, the hydrocarbon feed comprising $C_{5+}$ hydrocarbon. The steam cracker feed is introduced into a radiant section of at least one steam cracking furnace and exposing the steam cracker feed in the steam cracking furnace to a temperature ≥400° C. under steam cracking conditions to produce a steam cracker effluent that is at least partially in the vapor phase. The steam cracker effluent is cooled to condense at least a portion of the vapor phase into a liquid phase. At least a portion of the steam cracker effluent's vapor phase is separated from the liquid phase in a fractionator, the separated vapor phase comprising molecular hydrogen, methane, and $C_{2+}$ hydrocarbon. The separated vapor phase is cooled to condense a steam cracker naphtha comprising diolefin and $C_{5+}$ hydrocarbon, which is divided into first and second steam cracker naphtha streams. A first reflux stream comprising at least a portion of the first steam cracker naphtha is introduced into the fractionator. The second steam cracker naphtha stream is hydroprocessed under hydroprocessing conditions effective for dimerization of at least a portion of the second steam cracker naphtha stream's hydrocarbon and hydrogenation of at least a portion of the second steam cracker naphtha stream's diolefin to produce a hydroprocessed steam cracker naphtha. During the second time interval, one or more of ethane, propane, and butanes are added to the hydrocarbon feed, which leads to an increase in foulant accumulation rate in the SCN. The amount of foulant in the SCN is decreased and the fouling of the fractionator is lessened by transferring to the fractionator a flow of a second reflux stream comprising at least a portion of hydroprocessed steam cracker naphtha in order to lessen foulant accumulation in the fractionator.

In other aspects, the invention relates to an apparatus for carrying out any of the foregoing aspects, and any other aspect within the broader scope of the invention.

DETAILED DESCRIPTION OF THE INVENTION

Definitions

Figure 1A:
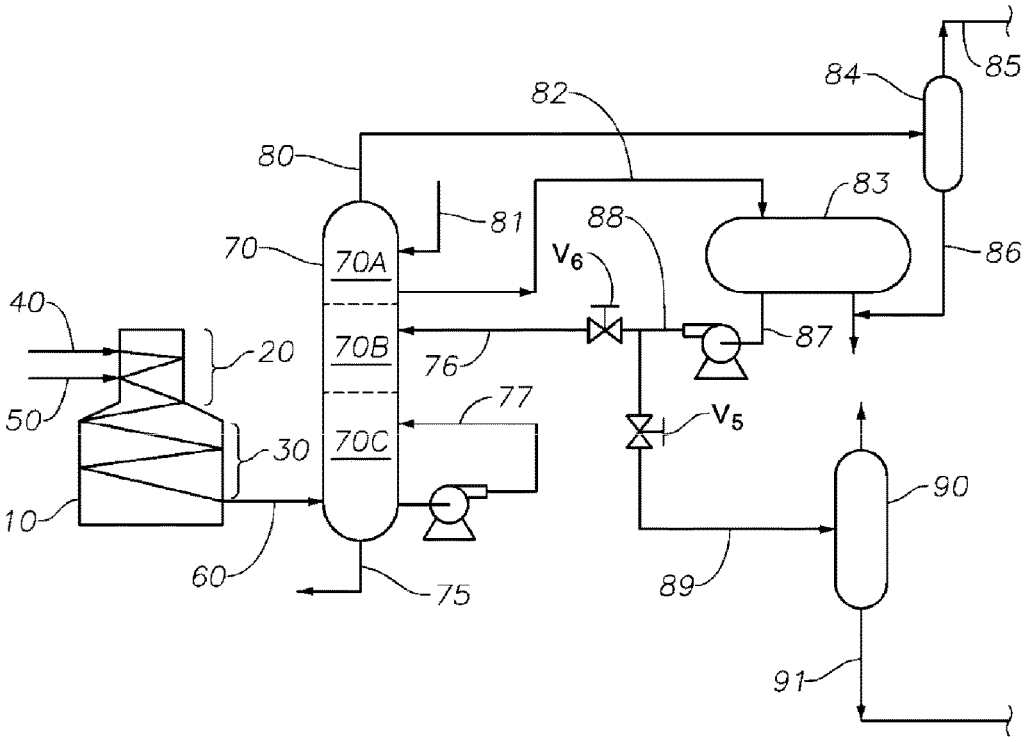
FIGS. 1A and 1B schematically illustrate a conventional process for steam cracking a hydrocarbon feed to produce products including light olefin, light saturated hydrocarbon, and hydroprocessed SCN.
Figure 1A:
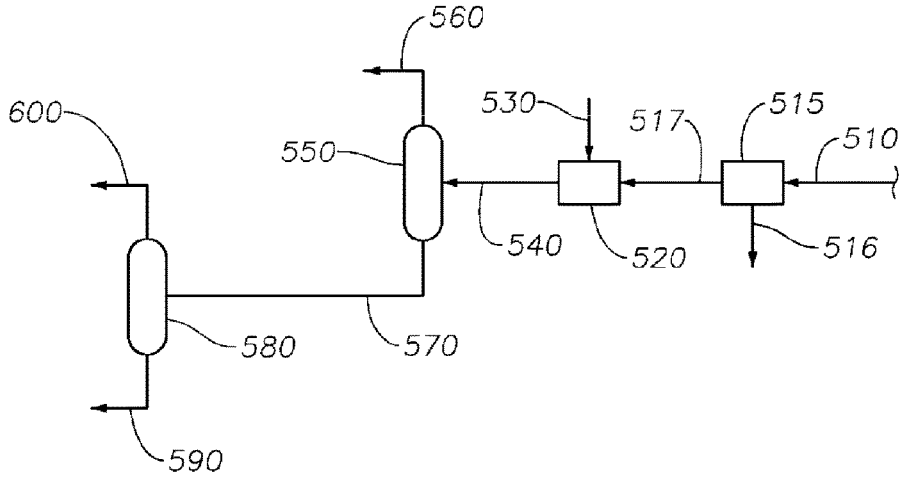

For the purpose of this description and appended claims, the following terms are defined:

The term "$C_n$" hydrocarbon means hydrocarbon having n carbon atom(s) per molecule, wherein n is a positive integer. The term "$C_{n+}$" hydrocarbon means hydrocarbon having at least n carbon atom(s) per molecule, wherein n is a positive integer. The term "$C_{n-}$" hydrocarbon means hydrocarbon having no more than n number of carbon atom(s) per molecule, wherein n is a positive integer. The term "hydrocarbon" means a class of compounds containing hydrogen bound to carbon, and encompasses (i) saturated hydrocarbon, (ii) unsaturated hydrocarbon, and (iii) mixtures of hydrocarbons, including mixtures of hydrocarbon compounds (saturated and/or unsaturated), including mixtures of hydrocarbon compounds having different values of n. A mixture of $C_n$-$C_m$ hydrocarbon, where m and n are integers and n<m, means a mixture containing at least $C_n$ and $C_m$ hydrocarbon and optionally one or more hydrocarbon compounds having a number of carbon atoms greater than n but less than m.

The term "unsaturate" or "unsaturated hydrocarbon" mean a $C_{2+}$ hydrocarbon containing at least one carbon atom directly bound to another carbon atom by a double or triple bond. The term "olefin" means an unsaturated hydrocarbon containing at least one carbon atom directly bound to another carbon atom by a double bond. In other words, an olefin is a compound which contains at least one pair of carbon atoms, where the first and second carbon atoms of the pair are directly linked by a double bond.

The term "Periodic Table" means the Periodic Chart of the Elements, as it appears on the inside cover of The Merck Index, Twelfth Edition, Merck & Co., Inc., 1996.

The invention generally relates to steam cracking, and more particularly to processes and apparatus for decreasing primary fractionator fouling. The invention is not limited to any particular forms of steam cracking or to particular hydrocarbon feeds to the steam cracking process.

Steam cracking is typically carried out by exposing a steam cracker feed to a temperature ≥400° C. in at least one steam cracker furnace operating under thermal pyrolysis conditions. The steam cracker feed is a typically a mixture comprising steam and a hydrocarbon feed. During the steam cracking process, at least a portion of the hydrocarbon feed reacts in the presence of the steam to produce a steam cracker effluent comprising light olefin, light saturated compounds, SCN, SCGO, and steam cracker tar. SCN, SCGO, and steam cracker tar are separated from light hydrocarbon vapor in a primary fractionator, which as described in the BACKGROUND, is subject to undesirable fouling when the hydrocarbon feed comprises light hydrocarbon in the vapor phase. The invention, which lessens or even substantially eliminates this fouling, will now be described in more detail. The invention is not limited to the aspects included in the following description. In particular this description is not meant to foreclose any other aspects within the broader scope of the invention.

Hydrocarbon Feeds

In certain aspects, the hydrocarbon feed comprises relatively high molecular weight hydrocarbons ("Heavy Hydrocarbon"), such as those which produce a relatively large amount of SCN, SCGO, and steam cracker tar during steam cracking. The Heavy Hydrocarbon typically comprises $C_{5+}$ hydrocarbon, which for example include one or more of steam cracked gas oil and residues, gas oils, heating oil, jet fuel, diesel, kerosene, coker naphtha, steam cracked naphtha, catalytically cracked naphtha, hydrocrackate, reformate, raffinate reformate, Fischer-Tropsch liquids, Fischer-Tropsch gases, distillate, crude oil, atmospheric pipestill bottoms, vacuum pipestill streams including bottoms, gas oil condensates, heavy non-virgin hydrocarbon streams from refineries, vacuum gas oils, heavy gas oil, naphtha contaminated with crude, atmospheric residue, heavy residue, $C_4$/residue admixture, naphtha/residue admixture, gas oil/residue admixture, and crude oil. The hydrocarbon feed can have a nominal final boiling point of at least about 600° F. (315° C.), generally greater than about 750° F. (399° C.), typically greater than about 850° F. (454° C.), for example greater than about 950° F. (510° C.). Nominal final boiling point means the temperature at which 99.5 weight percent of a particular sample has reached its boiling point. The hydrocarbon feed can comprise ≥1 wt. % of Heavy Hydrocarbon, based on the weight of the hydrocarbon feed, e.g., ≥25 wt. %, such as ≥50 wt. %, or ≥75 wt. %, or ≥90 wt. %, or ≥99 wt. %.

In other aspects, the hydrocarbon feed comprises one or more relatively low molecular weight hydrocarbon (Light Hydrocarbon), such as one or more of ethane, propane and butanes. The relative amounts of Light Hydrocarbon (typically in the vapor phase) and Heavy Hydrocarbon (typically in the liquid phase) in the hydrocarbon feed can range from 100% (weight basis) Light Hydrocarbon to 100% (weight basis) Heavy Hydrocarbon, although typically there is at least about 1% Light Hydrocarbon present in the hydrocarbon feed. For example, the hydrocarbon feed can comprise ≥1 wt. % of Light Hydrocarbon, based on the weight of the hydrocarbon feed, e.g., ≥25 wt. %, such as ≥50 wt. %, or ≥75 wt. %, or ≥90 wt. %, or ≥99 wt. %. Although hydrocarbon feeds comprising Light Hydrocarbon typically produce a greater yield of $C_2$ unsaturates (ethylene and acetylene) than do hydrocarbon feeds comprising Heavy Hydrocarbon, the steam cracking Light Hydrocarbon also produces less SCN, SCGO, and steam cracker tar. Light Hydrocarbon typically includes substantially saturated hydrocarbon molecules having fewer than five carbon atoms, e.g., ethane, propane, and mixtures thereof (e.g., ethane-propane mixtures or "E/P" mix). For ethane cracking, a concentration of at least 75% by weight of ethane is typical. For E/P mix, a concentration of at least 75% by weight of ethane plus propane is typical, the amount of ethane in the E/P mix being ≥20.0 wt. % based on the weight of the E/P mix, e.g., in the range of about 25.0 wt. % to about 75.0 wt. %. The amount of propane in the E/P mix can be, e.g., ≥20.0 wt. %, based on the weight of the E/P mix, such as in the range of about 25.0 wt. % to about 75.0 wt. %.

The steam cracking process can be configured to utilize a hydrocarbon feed comprising Heavy Hydrocarbon during a first time interval and then utilizes a hydrocarbon feed comprising light hydrocarbon during a second time interval. This can be carried out while maintaining the mass flow rate of hydrocarbon feed to the steam cracking process substantially constant during the first and second periods, e.g., by substituting a Light Hydrocarbon for a portion of the Heavy Hydrocarbon in the hydrocarbon feed. For example, during the first time interval, the hydrocarbon feed comprises ≥50% (weight basis, based on the weight of hydrocarbon feed) of Heavy Hydrocarbon, e.g., ≥75%, such as ≥90%, or ≥99%, with the balance (if any) being comprised of Light Hydrocarbon. During the second time interval, the hydrocarbon feed comprises ≥50% (weight basis, based on the weight of hydrocarbon feed) of Light Hydrocarbon, e.g., ≥75%, such as ≥90%, or ≥99%, with the balance (if any) being comprised of Heavy Hydrocarbon. Optionally, the weight of hydrocarbon feed introduced into the steam cracker is substantially constant during the first and second time intervals, e.g., varies by no more than about +/−50% (weight basis), such as +/−25%, or +/−10%. Although shorter durations can be used, the durations of the first and second time intervals are each typically ≥24 hours, e.g., ≥1 week, such as ≥1 month, or ≥1 year. For example, the duration of the first time interval and/or the duration of the second time interval can be in the range of from 1 day to 1 year, e.g., 1 week to 6 months.

Steam Cracking Process Conditions

The steam cracking is carried out in at least one steam cracking furnace, the steam cracking furnace comprising a radiant section and a convection section. Fired heaters are located in the radiant section, and flue gas from combustion carried out with the fired heaters travel upward from the radiant section, through the convection section, and then away from the steam cracker furnace's flue gas outlet. The hydrocarbon feed is typically preheated by indirect exposure to the flue gases in the convection section. The pre-heated hydrocarbon feed is then combined with steam to produce the steam cracker feed. The steam cracker feed is typically subjected to additional pre-heating in the convection section. The pre-heated steam cracker feed is then transferred to the radiant section, where the steam cracker feed is indirectly exposed to the combustion carried out by the burners.

The steam cracker feed typically comprises steam in an amount in the range of from 10.0 wt. % to 90.0 wt. %, based on the weight of the hydrocarbon+steam mixture, with the remainder comprising (or consisting essentially of, or consisting of) the hydrocarbon feed. In certain aspects, the weight ratio of steam to hydrocarbon feed is in the range of from 0.1 to 1.0, e.g., a ratio of 0.2 to 0.6.

Steam cracking conditions typically include, e.g., exposing the steam cracker to a temperature (measured at the radiant section's pyrolysis product outlet) ≥400° C., e.g., in the range of 400° C. to 900° C., and a pressure ≥0.1 bar, for a steam cracking residence time in the range of from about 0.01 second to 5.0 seconds.

In certain aspects, the hydrocarbon feed comprises ≥50% (weight basis, based on the weight of hydrocarbon feed) of Heavy Hydrocarbon, and steam cracker feed comprises 0.2 to 1.0 kg steam per kg hydrocarbon. The balance of the hydrocarbon feed can be Light Hydrocarbon, for example. In these aspects, the steam cracking conditions generally include one or more of (i) a temperature in the range of 760° C. to 880° C.; (ii) a pressure in the range of from 1.0 to 5.0 bar (absolute), or (iii) a cracking residence time in the range of from 0.10 to 2.0 seconds. The steam cracker effluent at the radiant coil outlet typically has a temperature in the range of about 760° C. to 880° C., e.g., about 790° C. (1450° F.).

In other aspects, the hydrocarbon feed comprises ≥50% (weight basis, based on the weight of hydrocarbon feed) of Light Hydrocarbon, and the steam cracker feed comprises 0.2 to 0.5 kg steam per kg hydrocarbon. The balance of the hydrocarbon feed can be Heavy Hydrocarbon, for example. In these aspects, the steam cracking conditions generally include one or more of (i) a temperature in the range of about 760° C. to 1100° C.; (ii) a pressure in the range of from 1.0 to 5.0 bar (absolute), or (iii) a cracking residence time in the range of from 0.10 to 2.0 seconds. The steam cracker effluent at the radiant coil outlet typically has a temperature in the range of about 760° C. to 1100° C., e.g., about 900° C. (1650° F.) for ethane or propane feeds.

Steam Cracking Process

In certain aspects, the invention is an improvement over a conventional steam cracking process. A typical conventional steam cracking process is illustrated schematically in FIGS. 1A and 1B. Certain improvements implemented in the conventional process in accordance with the invention are illustrated schematically in FIGS. 2A and 2B. As shown in FIG. 1A, a hydrocarbon feed hydrocarbon is conducted via line 40 to a steam cracker furnace 10 having two main sections: a convection section 20 and a radiant section 30. The hydrocarbon feed is introduced into convection coils located in the furnace's convection section. Steam is introduced into the convection coils via line 50. Inlet line 40 and associated feed-handling equipment are adapted so that the hydrocarbon feed can comprise Light Hydrocarbon (typically in the vapor phase) and/or Heavy Hydrocarbon (typically in the liquid phase).

The hydrocarbon feed is heated and vaporized in the convection section, e.g., by indirect contact with hot flue gas from the radiant section and by direct contact with the steam introduced into the convection coils via line 50. The mixture of steam and vaporized hydrocarbon feed (the steam cracker feed) is typically preheated in convection coils located proximate to the lower end of the steam cracker furnace's convection section. The preheated steam cracker feed is transferred, typically using cross-over piping (not shown), from the outlet of the convection tubes to the inlet of radiant tubes located in radiant section 30.

Optionally, e.g., when the hydrocarbon feed comprises certain Heavy Hydrocarbon, the steam cracking furnace has at least one vapor/liquid separation device (sometimes referred to as flash pot or flash drum) integrated therewith. When used, the vapor-liquid separator is configured for upgrading the hydrocarbon feed (e.g., by upgrading the hydrocarbon+steam mixture and/or preheated hydrocarbon+steam mixture) upstream of the steam cracking furnace's radiant section. It can be desirable to integrate a vapor-liquid separator with the furnace when the hydrocarbon feed comprises ≥1.0 wt. % of non-volatiles, e.g., ≥5.0 wt. %, such as 5.0 wt. % to 50.0 wt. % of non-volatiles having a nominal boiling point ≥1400° F. (760° C.). It is particularly desirable to integrate a vapor/liquid separator with the pyrolysis furnace when the non-volatiles comprise asphaltenes, such as pyrolysis feedstock's hydrocarbon comprises ≥ about 0.1 wt. % asphaltenes based on the weight of the pyrolysis feedstock's hydrocarbon component, e.g., ≥about 5.0 wt. %. Conventional vapor/liquid separation devices can be utilized to do this, though the invention is not limited thereto. Examples of such conventional vapor/liquid separation devices include those disclosed in U.S. Pat. Nos. 7,138,047; 7,090,765; 7,097,758; 7,820,035; 7,311,746; 7,220,887; 7,244,871; 7,247,765; 7,351,872; 7,297,833; 7,488,459; 7,312,371; 6,632,351; 7,578,929; and 7,235,705, which are incorporated by reference herein in their entirety. Typically, a vapor phase is separated from the hydrocarbon feed in the vapor/liquid separation device. The separated vapor phase is conducted away from the vapor/liquid separator to the radiant coils for pyrolysis. The liquid-phase separated from the hydrocarbon feed can be conducted away from the vapor/liquid separation device, e.g., for storage and/or further processing.

The pre-heated steam cracker feed is introduced into the radiant section 30, where at least a portion of the steam cracker feed's hydrocarbon is pyrolysed to produce $C_{2+}$ olefin. The steam cracker feed is typically in the vapor phase at the inlet of the radiant coils, e.g., ≥90 wt. % of the steam cracker feed is in the vapor phase, such as ≥95 wt. %, or ≥99 wt. %. The steam cracker feed in the radiant coils is exposed to a temperature ≥400° C. in order to convert at least a portion of the feed's hydrocarbon molecules to $C_{2+}$ olefins by pyrolysis. Suitable pyrolysis conditions in the radiant section include, e.g., exposing the steam cracker feed to a temperature (measured at the outlet of the radiant coils) ≥400° C., e.g., in the range of 400° C. to 900° C., and a pressure ≥0.1 bar (absolute), for a residence time in the range of from about 0.01 second to 5.0 seconds. For example, the steam cracking conditions can include one or more of (i) a temperature ≥760° C., e.g., in the range of about 760° C. to about 880° C.; (ii) a pressure ≥0.5 bar (absolute), e.g., in the range of from about 1.0 to about 5.0 bar, such as in the range of from about 1.1 to about 2.5 bar; or (iii) a residence time in the range of from about 0.10 to about 2.0 seconds.

The radiant section's steam cracker effluent is conducted away via line 60, and generally comprises, unconverted steam cracker feed and pyrolysis products. The pyrolysis products generally include the $C_{2+}$ olefin, molecular hydrogen, acetylene, aromatic hydrocarbon, saturated hydrocarbon, $C_{3+}$ diolefin, and typically one or more of aldehyde, acidic gases such as $H_2S$ and/or $CO_2$, and mercaptan.

The radiant section's steam cracker effluent can be quenched (e.g., by contacting with a quench oil boiling in the SCGO boiling range) in a quenching zone (not shown) upstream of primary fractionator 70. Conventional primary fractionators and associated equipment can be used, e.g., those described in U.S. Pat. No. 8,083,931, which is incorporated by reference herein in its entirety. Additional stages for removing heat (such as one or more transfer line heat exchangers) and removing tar (such as tar drums) can be located in or upstream of primary fractionator 70, if desired.

One conventional primary fractionator includes three regions, as shown in FIG. 1A: a stripping region 70C located proximate to the lower end of the fractionator, a rectification region 70B located above the stripping region, and a quenching region 70A located above the rectification region for quenching, e.g., with quench water, separated vapor conducted from the rectification region. Steam cracker tar is withdrawn from primary fractionator 70 via line 75. Bottoms pump-around loop 77 withdraws an SCGO boiling-range oil proximate to the lower end of the primary fractionator's stripping region and recycles the oil at a location that is typically proximate to the upper end of the stripping region but below the primary fractionator's rectification region. Vapor-phase effluent from the rectification region is quenched in the primary fractionator's quench region using quench water introduced via conduit 81. Quenching the vapor-phase effluent condenses at least a portion of SCN present in the vapor-phase effluent. Condensed SCN and heated quench water are withdrawn from a location proximate to the bottom of the primary fractionator's quench region via line 82. SCN is separated from quench water in separator drum 83, with SCN returned to the rectification region of the primary fractionator as reflux to reflux inlet 76 via pump inlet line 87, pump outlet line 88, and valve V6. Valve means V5 and V6 are adjusted to maintain the desired amount of SCN reflux volumetric flow rate and to periodically purge the reflux line in the event the amount of foulant and/or foulant precursors in the reflux SCN exceeds a predetermined desired amount. Adjusting the valves controls the amount of the first SCN stream conducted to fractionator 70 as reflux via line 76 and the amount of the second naphtha stream conducted away for further processing, e.g., in hydroprocessing stage 520. The SCN can be purged if the combined amount of foulant including one or more of styrene, indene, dicyclopentadiene, divinylbenzene, decalin, tetralin, naphthalene, and alkylated derivatives thereof exceed approximately 0.1 wt. % in the reflux SCN of line 76. This can be carried out by at least partially closing valve V6 and/or at least partially opening V5. Foulant can be removed from the second SCN stream, e.g., by treating the stream in hydroprocessing stage 520. An external gasoline source (not shown) is connected to line 76 during purging to maintain primary fractionator operation conditions. After purging is completed, flow from the external gasoline source is curtailed and valves V5 and V6 can be adjusted to restore flow rates in lines 76 and 89, e.g., to substantially the flow rates subsisting before purging.

Figure 1B:
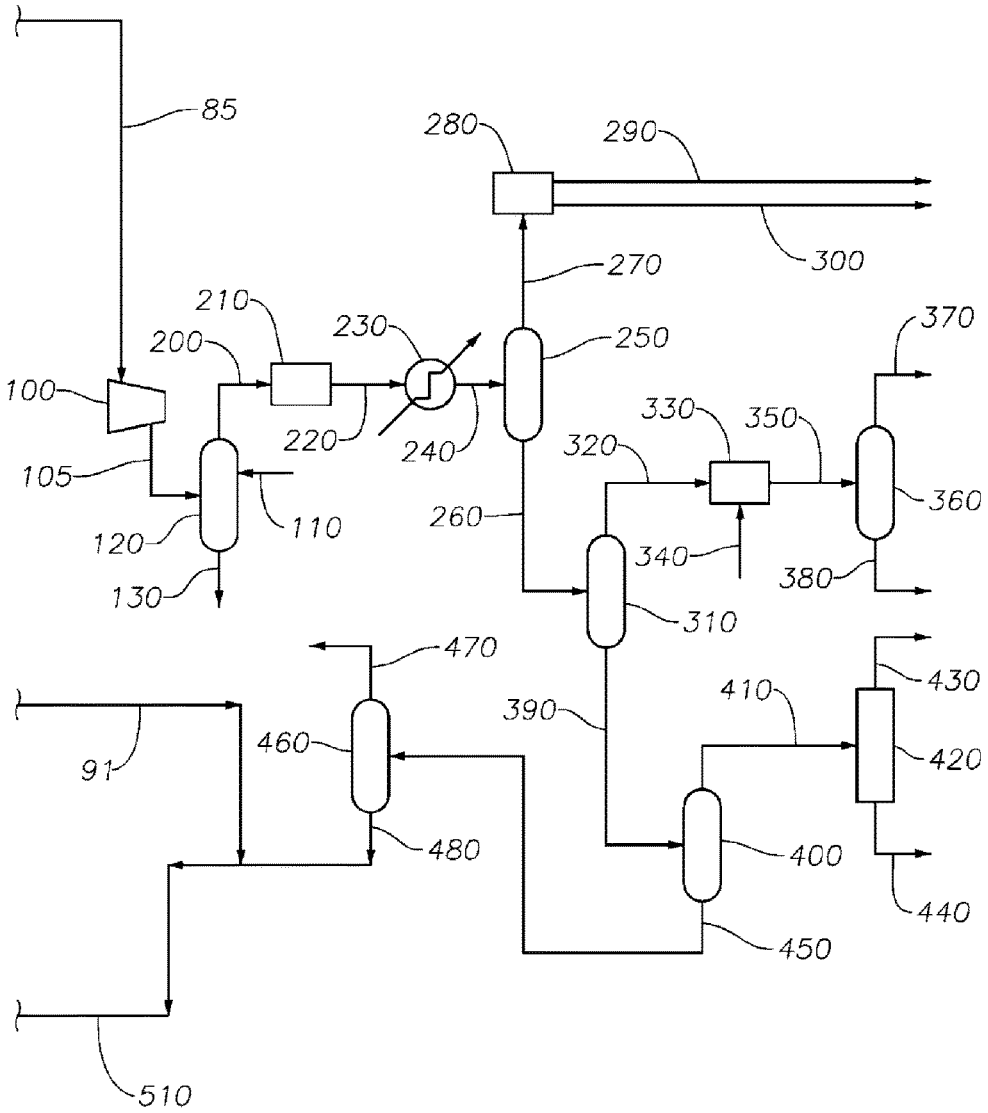

Quenched effluent, primarily in the vapor phase, is conducted away from stage 70 to separator drum 84 via line 80. Any water remaining in the quenched effluent is separated in drum 84 and conducted via line 86 to a quench water drain located in the lower region of drum 83. As shown in FIG. 1B, quenched vapor-phase effluent is conducted away from drum 84 via line 85 to compression stage 100 to produce a process stream 105. When utilizing the specified steam cracker feed and the specified steam cracker conditions, the process stream can comprise, e.g., ≥10.0 wt. % of $C_{2+}$ olefin, ≥1.0 wt. % of $C_{6+}$ aromatic hydrocarbon, ≥0.1 wt. % of diolefin, saturated hydrocarbon, molecular hydrogen, acetylene, $CO_2$, aldehyde, and $C_{1+}$ mercaptan, and $CO_2$.

A lean aqueous amine mixture is provided via line 110 to stage 120, where the process stream contacts and combines with the lean aqueous amine mixture. At least a portion of the process stream's acidic gases, e.g., $H_2S$ and/or $CO_2$ are removed from the process stream in stage 120. The acid gases are transferred from the process stream to the aqueous amine mixture in stage 120, and the removed acid gases (or ionized fragments thereof) are conducted away as components of the rich aqueous amine mixture via line 130. An upgraded process stream is conducted away from stage 120 via line 200 to water-removal stage 210. Some conventional steam crackers include additional removal stages, such as those utilizing caustic for removing $CO_2$ from the upgraded process stream These additional stages can be located before or after (or instead of) amine contactor 120, but typically upstream of stage 210.

At least a portion of any water present in the upgraded process stream, e.g., as water vapor, is removed by one or more dryers located in stage 210. A dried process stream is conducted away from stage 210 via line 220 and is then exposed to a temperature of, e.g., ≤100.0° C. in stage 230 to produce a cooled process stream. The cooled process stream is conducted via line 240 to separation stage 250, where a stream comprising primarily a mixture of methane and molecular hydrogen is conducted away via line 270. If desired, molecular hydrogen (line 290) and/or methane (line 300) can be separated from the mixture, utilizing, e.g., one or more cold boxes 280.

A demethanized process stream can be conducted away from separation stage 250 via line 260 to separation stage 310 for separating at least a portion of any $C_2$ hydrocarbon from the demethanized process stream. The $C_2$ hydrocarbon (generally a mixture of ethane, ethylene, and acetylene) can be conducted away from stage 310 via line 320 to acetylene conversion stage 330. Stage 330 utilizes molecular hydrogen from line 340 (obtained, e.g., from line 290) and a catalytically effective amount of at least one acetylene conversion catalyst operating under acetylene conversion conditions to convert at least a portion of the acetylene to ethylene. An upgraded $C_2$ hydrocarbon mixture is conducted away from stage 330 via line 350 to separation stage 360 (e.g., a splitter) for separating ethylene (conducted away via line 370) from ethane (conducted away via line 380).

$C_{3+}$ hydrocarbon is conducted away from stage 310 via line 390 to stage 400, for separating $C_3$ hydrocarbons and conducting these away via line 410. A splitter 420, for example, can be utilized from separating propylene (conducted away via line 430) and propane (conducted away via line 440).

$C_{4+}$ hydrocarbon is conducted away from stage 400 via line 450 to separation stage 460, for separating $C_4$ hydrocarbons (conducted away via line 470) and $C_{5+}$ hydrocarbons, which are conducted via lines 480 and 510 to separation stage 515. SCN in line 88 beyond that need for reflux in primary fractionator 70 can be added to the $C_{5+}$ hydrocarbon stream in line 510 via line 91. This is typically carried out by decreasing reflux flow by constricting valve V6 and opening valve V5 to achieve the desire amount of reflux to primary fractionator 70. Excess reflux is conducted through valve V5 via line 89 to separation stage 90, where at least a portion of any water is removed from the excess reflux. When stage 90 includes at least one stripper, e.g., a steam stripper, vapor-phase stripper effluent recovered from stage 90 can be combined with the vapor-phase effluent in line 80 for recovery of additional hydrocarbon in drum 84.

Stage 515 is utilized for removing cyclic hydrocarbon in the SCN boiling range, mainly $C_6$ and $C_7$ aromatics, which are conducted away via line 516. An upgraded SCN is conducted away from stage 515 via line 517 to hydroprocessing stage 520. The upgraded SCN typically comprises $C_{6+}$ olefin, normal $C_{6+}$ hydrocarbon, iso-$C_{6+}$ hydrocarbon, and ≥0.1 wt. % of $C_6$ diolefin. The upgraded SCN is hydroprocessed in hydroprocessing stage 520 in the presence of molecular hydrogen (added via line 530, and obtained, e.g., from line 290) and a catalytically effective amount of at least one hydroprocessing catalyst. The hydroprocessing typically removes ≥75 wt. % of the upgraded SCN's diolefin, e.g., ≥90 wt. %, such as ≥99 wt. %. The hydroprocessing also removes ≥75 wt. % of the upgraded SCN's sulfur (e.g., mercaptan sulfur, thiophenic sulfur, etc.), e.g., ≥90 wt. %, such as ≥99 wt. %.

A hydroprocessed SCN is conducted away from stage 520 via lime 540 to separation stage 550. Stage 550 typically includes at least one fractionator, e.g., an SCN splitter, for separating and conducting away first and second hydroprocessed SCN streams. The first hydroprocessed SCN stream is conducted away from separation stage 550 via line 560. The second hydroprocessed SCN stream is conducted away from stage 550 via line 570. The first hydroprocessed SCN stream is utilized, e.g., as a motor gasoline blending component. The second hydroprocessed SCN stream is typically conducted away for additional separations, e.g., in stage 580. The additional separations, carried out, e.g., in one or more re-run towers, including separations carried out in at least one re-run tower operating at sub-atmospheric pressure. A bottoms stream comprising heavy hydroprocessed SCN is typically conducted away from stage 580 via line 590, the bottoms stream typically comprising $C_9$ to $C_{12}$ hydrocarbon, e.g., $C_9$ to $C_{11}$, and having an atmospheric boiling point range overlapping that of SCGO. An overhead stream comprising light hydroprocessed SCN is conducted away via line 600. The light hydroprocessed SCN (a re-run SCN) typically includes $C_6$ to $C_{10}$ hydrocarbon, e.g., $C_6$ to $C_9$. The re-run SCN is typically utilized as a motor gasoline blending component.

In response to increasing availability and decreasing cost, it has become desirable to increase the relative amount of vapor-phase hydrocarbon (e.g., Light Hydrocarbon), such as one or more of ethane, propane, and butane, in the hydrocarbon feed to steam cracking furnace 10. It would be particularly desirable to increase the relative amount of vapor-phase hydrocarbon in the hydrocarbon feed, e.g., up to 100 wt. % vapor phase hydrocarbon, without significantly reconfiguring steam cracking furnace 10 or primary fractionator 70. It would also be desirable to configure new grass-roots steam crackers so that they can operate using gaseous hydrocarbon feeds while remaining capable of reconfiguration for operation using at least some liquid-phase hydrocarbon feed (Heavy Hydrocarbon) should it become advantageous to do so, without significant changes to furnace 10 or primary fractionator 20. As explained in the BACKGROUND, utilizing vapor-phase hydrocarbon feed leads to an increase in the amount of foulant precursors in the SCN stream of line 87. Since this SCN stream is introduced into primary fractionator 70 via pump outlet line 88 and valve V6, increased primary fractionator fouling occurs. Utilizing vapor-phase hydrocarbon feeds also leads and increased emulsification of the naphtha-quench water mixture, which decreases naphtha separation efficiency in drum 83, leading to a further increase in primary fractionator fouling. Certain aspects of the invention are based in part on the discovery that these difficulties can be at least partially overcome without significantly reconfiguring steam cracking furnace 10 or primary fractionator 70, and with little or no need to employ the undesirable methods disclosed in the Jain reference. It has been found that adding at least a portion of the hydroprocessed SCN obtained from hydroprocessing stage 520 to primary fractionator 70 as a reflux stream (e.g., as a second reflux stream) unexpectedly decreases the amount of foulant in the SCN stream of line 87, and also the amount of primary fractionator fouling. While not wishing to be bound by any theory or model, it is believed that in addition to diolefin saturation and sulfur removal, the hydroprocessing of stage 520 produces dimers of at least a portion of the $C_{5+}$ hydrocarbon in line 510. The dimerization increases the amount of $C_9$-$C_{12}$ hydrocarbon in the hydroprocessed SCN over the amount of $C_9$-$C_{12}$ hydrocarbon present in the $C_{5+}$ hydrocarbon stream of line 510. When at least a portion of the hydroprocessed SCN is added to SCN reflux obtained from line 87, the amount of foulant in the SCN of line 70 and the fouling in primary fractionator 70 is lessened or even eliminated. The decrease in SCN foulant content and the decrease in fractionator fouling are believed to result from an increased amount of $C_9$-$C_{12}$ hydrocarbon in the hydroprocessed SCN in reflux line 76, particularly the $C_9$ and $C_{10}$ hydrocarbon, and the decreased amount of $C_{5+}$ diolefin.

Certain aspects of the invention include selecting hydroprocessing conditions in stage 520 to produce a hydroprocessed SCN comprising ≤1.0 wt. % of diolefin and ≥0.01 wt. % of dimers of $C_{5+}$ hydrocarbon in the feed to stage 520, the weight percent being based on the weight of hydroprocessed SCN. Typically, the hydroprocessed SCN comprises (i) ≥0.1 wt. % of $C_9$-$C_{12}$ dimers, e.g., ≥0.5 wt. %, or 1.0 wt. % and (ii) ≤1.0 wt. % of diolefin, e.g., ≤0.1 wt. %, such as ≤0.01 wt. %. The hydroprocessing typically removes ≥75 wt. % of the upgraded SCN's diolefin, e.g., ≥90 wt. %, such as ≥99 wt. %. The hydroprocessing of stage 520 is typically operated to dimerize ≥0.1% (weight basis) of (i) $C_5$ hydrocarbon and/or (ii) $C_6$ hydrocarbon present in the upgraded SCN of line 517, e.g., ≥0.5 wt. %, such as ≥1.0 wt. %. Those skilled in the art of steam cracking can carry out SCN hydroprocessing to achieve these values, e.g., the amount of diolefin saturation, without undue experimentation. Should any cracking of the upgraded SCN occur in stage 520, dimerization of the olefinic and/or paraffinic cracked fragments is also within the scope of the invention, and beneficially increases the heavy hydrocarbon tail in the molecular weight distribution of the re-run SCN.

The choice of hydroprocessing catalyst is not critical. Any catalyst capable of removing diolefin and producing dimers in the upgraded SCN can be used, including catalyst comprising at least one element selected from Groups 7-10 of the Periodic Table and optionally at least one element selected from Groups 4-6 of the Periodic Table. Catalyst containing ≥1 wt. % (based on the weight of the catalyst) of one or more of Pt, Pd, Ni, Co, Mo, and W are suitable. The catalyst can include one or more refractory oxide, e.g., silica and/or alumina as binder or support material. Conventional SCN hydroprocessing catalysts can be used, but the invention is not limited thereto. Catalytic hydroprocessing conditions in stage 520 typically include a temperature in the range of from 40° C. to about 370° C., a pressure in the range of about 6 bar (absolute) to about 35 bar (absolute), and a weight hourly space velocity (WHSV) feed rate per weight of catalyst of from about 1 $h^{-1}$ to about 15 $h^{-1}$. The hydroprocessing is typically carried out to preserve ≥10 wt. % of monoolefin present in the hydroprocessor feed of line 517, e.g., ≥25 wt. %, such as ≥50 wt. %, or ≥75 wt. %. Such mild hydroprocessing conditions do not typically result in removal of a significant amount of sulfur from the hydroprocessor feed of line 517, e.g., ≤1 wt. % is removed during the hydroprocessing, such as ≤0.1 wt. %.

Figure 2A:
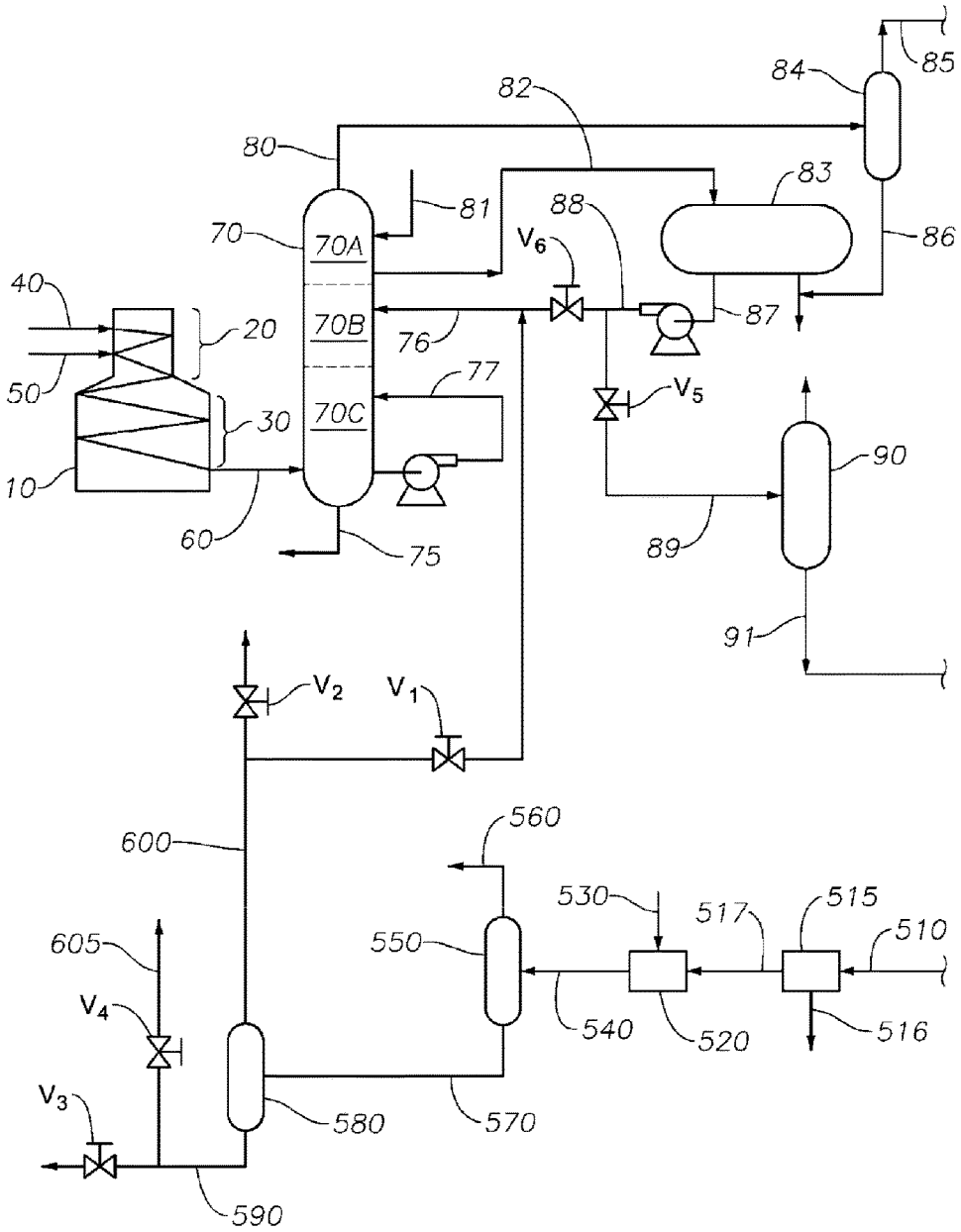
FIGS. 2A and 2B schematically illustrate a process for steam cracking a hydrocarbon feed, the process being configured in accordance with certain aspects of the invention and including adding hydroprocessed SCN to the primary fractionator's SCN reflux.
Figure 2B:
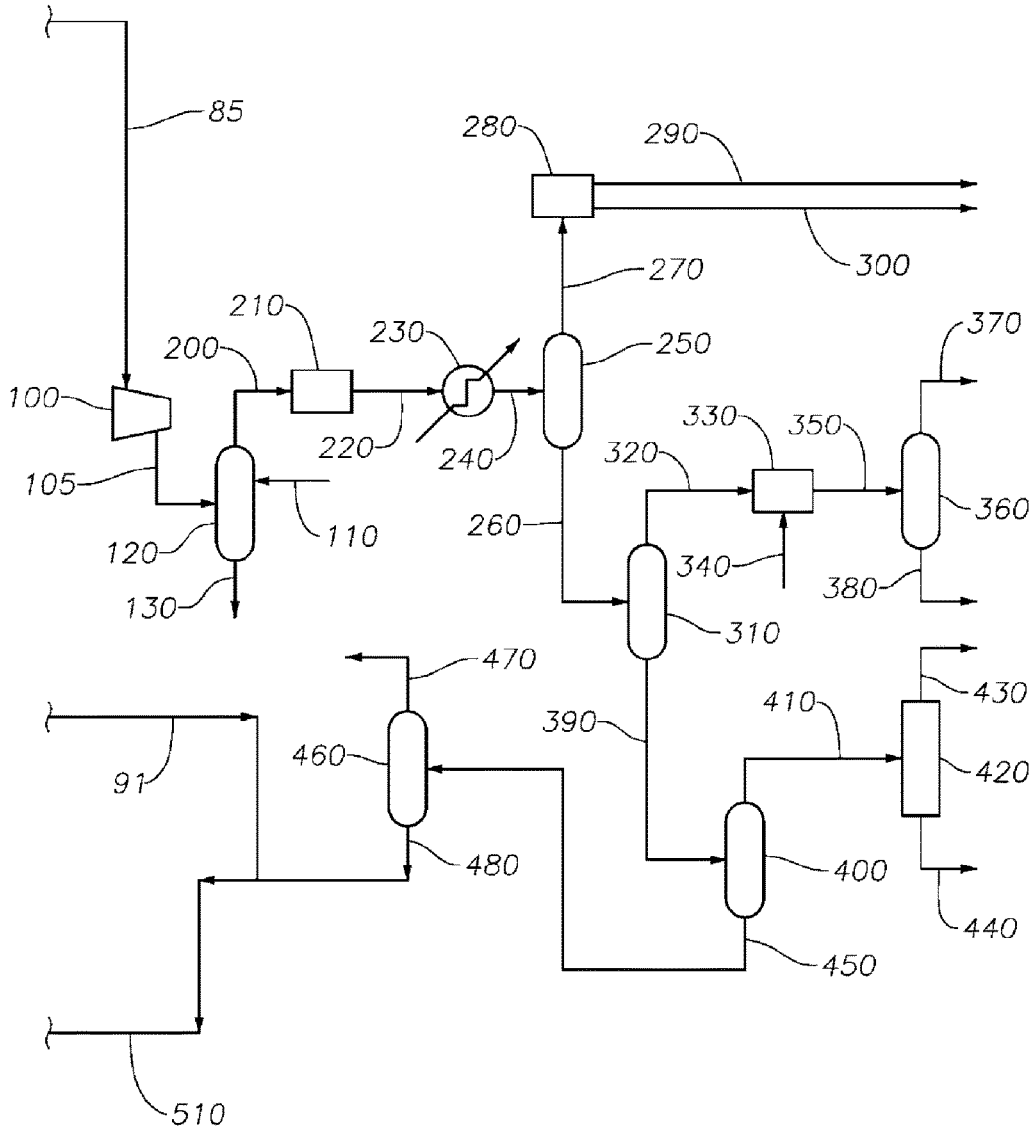

The process can further include separating a heavy (e.g., $C_{6+}$) SCN from the hydroprocessed SCN, and then separating (i) a $C_6$-$C_{10}$ re-run SCN (typically $C_6$-$C_9$) and (ii) a $C_{9+}$ hydrocarbon bottoms stream (typically $C_9$-$C_{12}$, e.g., $C_9$-$C_{11}$) from the heavy SCN in a separation stage utilizing at least one re-run tower operating under sub-atmospheric pressure. Those skilled in the art will appreciate that hydrocarbon separations are imperfect, typically resulting in an overlap in the number of carbon atoms between compounds at the upper end of the re-run SCN boiling range and in compounds at the lower end of the bottoms stream's boiling range. As shown in FIG. 2A. At least a portion of the re-run SCN of line 60 is combined with SCN of line 87 and introduced as reflux into line 76. Optionally, at least a portion of re-run tower bottoms of line 590 is introduced into the primary fractionator, e.g., into the primary fractionator's bottoms pump-around loop 77. Aspects of the invention illustrated in FIGS. 2A and 2B will now be described in more detail. The invention is not limited to these aspects, and this description is not meant to foreclose other aspects within the broader scope of the invention, such as aspects where no further separation of the hydroprocessed SCN is carried out before combining the hydroprocessed SCN with the SCN of line 87.

As shown in FIG. 2A, re-run SCN is conducted away from stage 580 via line 600. The re-run SCN of line 600 typically comprises ≥5% (by weight, based on the weight of re-run SCN) of $C_8$-$C_{10}$ hydrocarbon, including $C_8$-$C_{10}$ hydrocarbon produced by dimerization in stage 520. Typically, the re-run SCN comprises ≥10% of $C_8$-$C_{10}$ hydrocarbon, e.g., ≥15%, such as ≥25%, or ≥50%. Valve means $V_1$ and $V_2$ are utilized to regulate the amount of re-run SCN added to the SCN obtained from pump outlet line 88 to achieve the desired volumetric flow rate of the combined SCN stream into line 76, e.g., to restore SCN flow in line 76 to an amount substantially the same as that before Light Hydrocarbon is introduced into the hydrocarbon feed. Typically, re-run SCN is added via valve V1 as a second reflux stream until the volumetric flow rate of the combined SCN in line 76 is within about +/−10% of the volumetric flow rate before the amount of vapor-phase hydrocarbon feed was increased. The process is advantageous in that primary fractionator fouling can be lessened or eliminated even when the volumetric flow rate of the combined SCN into line 76 is <0.9 times the amount of SCN reflux before the amount of vapor-phase hydrocarbon feed was increased, e.g., in the range of 0.5 times to 0.89 times, or 0.6 times to 0.75 times. Typically, ≥25% (weight basis) of the second reflux stream is the light hydroprocessed steam cracker naphtha (e.g., re-run SCN), e.g., ≥50%, such as ≥75%, or ≥90%. It is believed that this results from the re-run SCN having fewer diolefin compounds and an increased amount of $C_9$ and $C_{10}$ normal and iso paraffin and of $C_9$ and $C_{10}$ normal and iso olefin than does the SCN from line 87. The location at which the re-run SCN is added to SCN obtained from the primary fractionator's quench fluid outlet (line 82) is not critical. In alternative aspects, the re-run SCN from valve V1 is added to one or more of line 82, drum 83, line 87, and line 88.

After the desired flow rate of the combined SCN to the primary fractionator's rectification region via line 76 has reached the desired value, valve means V1-V6 can be adjusted to decrease or halt the flow of re-run SCN through valve V1 and restore the flow of re-run SCN through valve V2. One advantage of the process is that after the desired volumetric flow rate of the combined SCN has been achieved, the primary fractionator's SCN reflux loop (lines 82, 87, 88), and V5, and V6, can remain in the steady state with little or no re-run SCN added via V1. Accordingly, the volumetric flow rate of re-run SCN away from the process via valve V2 is typically restored to its original value before diversion of re-run SCN through V1. Alternatively or in addition, the amount of foulant in the SCN of line 87 can be monitored, e.g., using conventional liquid chromatography. When the amount of foulant exceeds a desired amount, e.g., a predetermined foulant amount of ≥0.1% (weight basis), or ≥1%, valve V1 can be at least partially opened and V6 at least partially closed in order to add re-run SCN to reflux line 76. Valve V5 can be at least partially opened if desired, e.g., to remove excess SCN reflux. Optionally, valve V5 is opened (or opened further), e.g., to purge SCN in response to increased foulant content. The amount of foulant in the SCN of line 87 is observed to decrease while the flow of re-run SCN to the fractionator is maintained. After the foulant amount has decreased to a value that is less than the predetermined amount, valves V1-V6 can be returned to their original configuration. The opening and closing of valves $V_1$-$V_6$ can be carried out as needed to keep foulant amount in the SCN of line 87 at or below the desired amount.

Another advantage of the process is that the need for an external gasoline source during SCN reflux purging is at least partially obviated. This advantage arises in part because the increased flow of fouled SCN away from reflux line 76 via valve V5 is compensated by a flow of hydroprocessed SCN into line 76 via valve V1. When an external gasoline source is utilized, it is typical to strip the gasoline of $O_2$ before adding the gasoline to reflux line 76, and also preferable to treat the gasoline with one or more antioxidants. Generally, the external gasoline source, when used, should have an oxygenate content ≤0.1% (weight basis, based on the weight of gasoline), e.g., ≤0.01%, such as 0.001%.

As shown in FIG. 2A, optional valve means V3 and V4 are operated to conduct away at least a first portion of stage 580 bottoms and to recycle to the process at least a second portion via line 605. The recycled bottoms can be utilized, e.g., for one or more of quenching the radiant coil effluent in line 60, fluxing the steam cracker tar of line 75, and further lessening fouling in fractionator 77 by introducing the bottoms into the tower via line 76 (into the rectification region) and/or line 77 (into the stripping region). It is believed that the presence of the bottoms stream's $C_9$-$C_{12}$ hydrocarbon in the stripping region and/or the rectification region decreases primary fractionator fouling.

Those skilled in the art of steam cracking will appreciate that although valve means V1-V6 are illustrates as mechanically-actuated valves, the invention can be practiced with other forms of valve means. For example, one or more of V1-V6 an include valves operated by a special purpose computer configured for that purpose. Alternatively, or in addition, one or more of valve means V1-V6 can be include hydrodynamic valving, where fluid flow through the valve means is regulated by one or more of temperature, pressure, heat flow, and fluid flow within the process itself.

The invention encompasses producing molecular hydrogen, $C_2$-$C_4$ saturated hydrocarbon, $C_2$ to C4 olefin, and $C_{5+}$ hydrocarbon, including SCN and SCGO, by any of the foregoing aspects and by any other aspect within the broader scope of the invention. The invention also encompasses polymerizing the one or more of the $C_2$-$C_4$ olefin and the resulting polymer.

All patents, test procedures, and other documents cited herein, including priority documents, are fully incorporated by reference to the extent such disclosure is not inconsistent and for all jurisdictions in which such incorporation is permitted.

While the illustrative forms disclosed herein have been described with particularity, it will be understood that various other modifications will be apparent to and can be readily made by those skilled in the art without departing from the spirit and scope of the disclosure. Accordingly, it is not intended that the scope of the claims appended hereto be limited to the examples and descriptions set forth herein but rather that the claims be construed as encompassing all the features of patentable novelty which reside herein, including all features which would be treated as equivalents thereof by those skilled in the art to which this disclosure pertains.

When numerical lower limits and numerical upper limits are listed herein, ranges from any lower limit to any upper limit are contemplated. The term "comprising" is synonymous with the term "including". Likewise whenever a composition, an element or a group of components is preceded with the transitional phrase "comprising", it is understood that we also contemplate the same composition or group of components with transitional phrases "consisting essentially of," "consisting of", "selected from the group of consisting of," or is "preceding the recitation of the composition, component, or components, and vice versa."

The invention claimed is:

1. A process for steam cracking hydrocarbon, the process comprising:

(a) combining a hydrocarbon feed with steam to produce a steam cracker feed;

(b) exposing the steam cracker feed to a temperature ≥400° C. under steam cracking conditions to produce a steam cracker effluent that is at least partially in the vapor phase;

(c) cooling the steam cracker effluent to condense a portion of the vapor phase into a liquid phase;

(d) separating in at least one fractionator at least a portion of the steam cracker effluent's vapor phase from the liquid phase, the separated vapor phase comprising molecular hydrogen, methane, and $C_{2+}$ hydrocarbon;

(e) cooling the separated vapor phase to condense a steam cracker naphtha comprising diolefin and $C_{5+}$ hydrocarbon;

(f) dividing the condensed steam cracker naphtha into first and second steam cracker naphtha streams, and introducing into the at least one fractionator a first reflux stream comprising at least a portion of the first steam cracker naphtha stream;

(g) hydroprocessing at least a portion of the second steam cracker naphtha stream under hydroprocessing conditions effective for dimerization of at least a portion of the second steam cracker naphtha stream's hydrocarbon and hydrogenation of at least a portion of the second steam cracker naphtha stream's diolefin to produce a hydroprocessed steam cracker naphtha; and (h) introducing to the at least one fractionator a second reflux stream comprising at least a portion of the hydroprocessed steam cracker naphtha, wherein the at least one fractionator comprises a primary fractionator having a stripping region, a rectification region, and a quenching region, the rectification region being located between the stripping region and the quenching region.

2. The process of claim 1, wherein the cooled steam cracker effluent is introduced into the stripping region, and at least part of the cooling of step (e) is carried out in the quenching region.

3. The process of claim 1, further comprising combining the first and second reflux streams to produce a combined reflux stream, wherein the combined reflux stream is introduced into the fractionator.

4. The process of claim 1, wherein the hydrocarbon feed comprises ≥25 wt. % of one or more of ethane, propane and butanes.

5. The process of claim 1, wherein the steam cracking conditions include a temperature in the range of 400° C. to 900° C., and a pressure ≥0.1 bar, and a residence time in the range of from about 0.01 seconds to 5.0 seconds, and wherein steam cracker feed has a steam: hydrocarbon feed weight ratio in the range of from 0.1 to 1.0.

6. The process of claim 1, wherein the hydroprocessing includes catalytic hydroprocessing, and the hydroprocessing conditions include a temperature in the range of from 40° C. to about 370° C., a pressure in the range of about 6 bar (absolute) to about 35 bar (absolute), and a weight hourly space velocity (WHSV) feed rate per weight of catalyst of from about 1 $h^{-1}$ to about 15 $h^{-1}$.

7. The process of claim 1, further comprising separating from the hydroprocessed steam cracker naphtha a first hydroprocessed steam cracker naphtha and a second hydroprocessed steam cracker naphtha, wherein (i) the separating of the first and second hydroprocessed steam cracker naphthas is carried out before step (h), (ii) the first hydroprocessed steam cracker naphtha comprises $C_5$ hydrocarbon, and (iii) the second hydroprocessed steam cracker naphtha comprises $C_{6+}$ hydrocarbon and includes at least a portion of the hydroprocessed steam cracker naphtha's dimers.

8. The process of claim 7, further comprising separating from the second hydroprocessed steam cracker naphtha a light hydroprocessed steam cracker naphtha and a heavy hydroprocessed steam cracker naphtha, wherein (i) the light hydroprocessed steam cracker naphtha comprises $C_6$-$C_{10}$ hydrocarbon and includes at least a portion of the hydroprocessed steam cracker naphtha's dimers, (ii) the heavy hydroprocessed steam cracker naphtha comprises $C_9$-$C_{12}$ hydrocarbon, and (iii) ≥90% of the second reflux stream is the light hydroprocessed steam cracker naphtha.

9. The process of claim 8, further comprising transferring to the at least one fractionator at least a portion of the heavy hydroprocessed steam cracker naphtha.

10. The process of claim 1, wherein the first steam cracker naphtha stream comprises foulant in an amount that decreases during step (h).

11. A method for lessening steam cracker fractionator fouling, the method comprising:

during a first time interval, (a) combining a hydrocarbon feed with steam to produce a steam cracker feed, the hydrocarbon feed comprising $C_{5+}$ hydrocarbon;

(b) introducing the steam cracker feed into a radiant section of at least one steam cracking furnace and exposing the steam cracker feed in the steam cracking furnace to a temperature ≥400° C. under steam cracking conditions to produce a steam cracker effluent that is at least partially in the vapor phase;

(c) cooling the steam cracker effluent to condense a portion of the vapor phase into a liquid phase;

(d) separating in at least one fractionator at least a portion of the steam cracker effluent's vapor phase from the liquid phase, the separated vapor phase comprising molecular hydrogen, methane, and $C_{2+}$ hydrocarbon;

(e) cooling the separated vapor phase to condense a steam cracker naphtha comprising diolefin and $C_{5+}$ hydrocarbon;

(f) dividing the condensed steam cracker naphtha into first and second steam cracker naphtha streams, and introducing into the at least one fractionator a flow of a first reflux stream comprising at least a portion of the first steam cracker naphtha stream;

(g) hydroprocessing at least a portion of the second steam cracker naphtha stream under hydroprocessing conditions effective for dimerization of at least a portion of the second steam cracker naphtha stream's hydrocarbon and hydrogenation of at least a portion of the second steam cracker naphtha stream's diolefin to produce a hydroprocessed steam cracker naphtha; and during a second time interval, (h) adding one or more of ethane, propane, and butanes to the hydrocarbon feed; and (i) introducing to the at least one fractionator a flow of a second reflux stream comprising at least a portion of the hydroprocessed steam cracker naphtha in order to lessen foulant accumulation in the fractionator, wherein the at least one fractionator comprises a primary fractionator having a stripping region, a rectification region, and a quenching region, the rectification region being located between the stripping region and the quenching region.

12. The method of claim 11, further comprising combining the flows of the first and second reflux streams to produce a combined flow of the first and second reflux streams, wherein the combined flow of the first and second reflux streams is introduced into the at least one fractionator.

13. The method of claim 11, wherein during the first time interval (i) the hydrocarbon feed comprises ≥50 wt. % of $C_{5+}$ hydrocarbon, (ii) the steam cracker feed has a steam: hydrocarbon feed weight ratio in the range of from 0.2 to 1, and (iii) the steam cracking conditions include a temperature in the range of 760° C. to 880° C., a pressure in the range of from 1.0 bar (absolute) to 5.0 bar (absolute), and a residence time in the range of from 0.10 to 2.0 seconds.

14. The method of claim 11, wherein during the second time interval (i) the hydrocarbon feed comprises >50 wt. % of one or more of ethane, propane, and butanes, (ii) the steam cracker feed has a steam: hydrocarbon feed weight ratio in the range of from 0.2 to 0.5, and (iii) the steam cracking conditions include a temperature in the range of about 760° C. to 1100° C.; a pressure in the range of from 1.0 bar (absolute) to 5.0 bar (absolute), and a residence time in the range of from 0.10 to 2.0 seconds.

15. The method of claim 11, wherein the hydroprocessing includes catalytic hydroprocessing, and the hydroprocessing conditions include a temperature in the range of from 40° C. to about 370° C., a pressure in the range of about 6 bar (absolute) to about 35 bar (absolute), and a weight hourly space velocity (WHSV) feed rate per weight of catalyst of from about 1 $h^{-1}$ to about 15 $h^{-1}$.

16. The method of claim 11, wherein the hydrocarbon feed in the steam cracker feed is introduced into the steam cracker in a first amount during the first time interval and a second amount during the second time interval, the second amount being within +/−10% of the first amount on a weight basis.

17. The method of claim 12, wherein the hydroprocessed steam cracker naphtha constitutes ≥10% of the combined flow of the first and second reflux streams.

18. The method of claim 17, further comprising separating from the hydroprocessed steam cracker naphtha a first hydroprocessed steam cracker naphtha and a second hydroprocessed steam cracker naphtha, wherein (i) the separating of the first and second hydroprocessed steam cracker naphthas is carried out before the transferring of the second reflux stream to the at least one fractionator, (ii) the first hydroprocessed steam cracker naphtha comprises $C_5$ hydrocarbon, and (iii) the second hydroprocessed steam cracker naphtha comprises $C_{6+}$ hydrocarbon and includes at least a portion of the hydroprocessed steam cracker naphtha's dimers.

19. The method of claim 18, further comprising separating from the second hydroprocessed steam cracker naphtha a light hydroprocessed steam cracker naphtha and a heavy hydroprocessed steam cracker naphtha, wherein (i) the light hydroprocessed steam cracker naphtha comprises $C_6$-$C_{10}$ hydrocarbon and includes at least a portion of the hydroprocessed steam cracker naphtha's dimers, (ii) the heavy hydroprocessed steam cracker naphtha comprises $C_9$-$C_{12}$ hydrocarbon, and (iii) the light hydroprocessed steam cracker naphtha constitutes ≥90% of the combined flow of the first and second reflux streams.

20. The method of claim 19, wherein during the second time interval after a predetermined foulant amount in the first steam cracker naphtha stream has been achieved, the flow of the second reflux stream is decreased and the flow of first reflux stream is increased.

* * * * *